US007011424B1

(12) United States Patent
Poulson

(10) Patent No.: US 7,011,424 B1
(45) Date of Patent: Mar. 14, 2006

(54) CANDLE FIREPLACE ILLUMINATOR

(76) Inventor: Sharon Poulson, 3157 E. Jerome Ave., Mesa, AZ (US) 85204

( * ) Notice: Subject to any disclaimer, the term of this patent is extended or adjusted under 35 U.S.C. 154(b) by 0 days.

(21) Appl. No.: 10/143,634

(22) Filed: May 10, 2002

Related U.S. Application Data

(60) Provisional application No. 60/290,173, filed on May 10, 2001.

(51) Int. Cl.
*F21V 35/00* (2006.01)

(52) U.S. Cl. ..... 362/161; 362/162; 362/163

(58) Field of Classification Search ..... 362/161, 362/162, 346, 352, 314, 447; D26/9–11, D26/23, 118; 126/552, 553
See application file for complete search history.

(56) References Cited

U.S. PATENT DOCUMENTS 464,486 A * 12/1891 Hoya ..... 362/162
3,826,606 A * 7/1974 Hicks ..... 431/295
4,172,275 A * 10/1979 Caverio ..... 362/159
4,907,140 A * 3/1990 Overstreet ..... 362/162
4,998,189 A * 3/1991 Guggemos ..... 362/278
5,264,996 A * 11/1993 Bele et al. ..... 362/162
5,579,180 A * 11/1996 Geller ..... 359/847
5,651,602 A * 7/1997 Tawil et al. ..... 362/18
5,797,671 A * 8/1998 Gess ..... 362/162
6,179,437 B1 * 1/2001 Hardy et al. ..... 362/162
2002/0139834 A1 * 10/2002 Becker ..... 229/103.11

* cited by examiner

*Primary Examiner*—Stephen Husar
*Assistant Examiner*—Hargobind S. Sawhney

(57) ABSTRACT

A candle fireplace illuminator that includes a multi-reflector element assembly that is foldable for storage and which unfolds into a three-sided, single-bottomed reflector assembly having four reflective elements and which has a bottom reflective element for supporting a number of candles on a number of candle holders or candlabras such that the candles may be used within a fireplace to provide illumination into a room by light reflecting from the four reflective surfaces.

1 Claim, 2 Drawing Sheets

CANDLE FIREPLACE ILLUMINATOR

This application claims benefit of 60/290,173 filed on May 10, 2001.

TECHNICAL FIELD

The present invention relates to accessories for fireplaces and more particularly to a candle fireplace insert that includes a multi-reflector element assembly that is foldable for storage and which unfolds into a three-sided, single-bottomed reflector assembly having four reflective elements and which has a bottom reflective element for supporting a number of candles on a number of candle holders or candelabras such that the candles may be used within a fireplace to provide illumination into a room by light reflecting from the four reflective surfaces.

BACKGROUND ART

Many individuals would enjoy having light from their fireplace but do not want the heat associated with burning wood or gas in the fireplace. It would be desirable, therefore, to have a reflector assembly that could be inserted into the fireplace which would have a number of reflective surfaces including a reflective bottom surface for reflecting light from burning candles out of the fireplace cavity and into a room.

GENERAL SUMMARY DISCUSSION OF INVENTION

It is thus an object of the invention to provide fireplace insert that includes a multi-reflector element assembly that is foldable for storage and which unfolds into a three-sided, single-bottomed reflector assembly having four reflective elements and which has a bottom reflective element for supporting a number of candles on a number of candle holders or candelabras such that the candles may be used within a fireplace to provide illumination into a room by light reflecting from the four reflective surfaces.

Accordingly, fireplace insert is provided. The candle fireplace illuminator includes a multi-reflector element assembly that is foldable for storage and which unfolds into a three-sided, single-bottomed reflector assembly having four reflective elements and which has a bottom reflective element for supporting a number of candles on a number of candle holders or candelabras such that the candles may be used within a fireplace to provide illumination into a room by light reflecting from the four reflective surfaces.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1A:
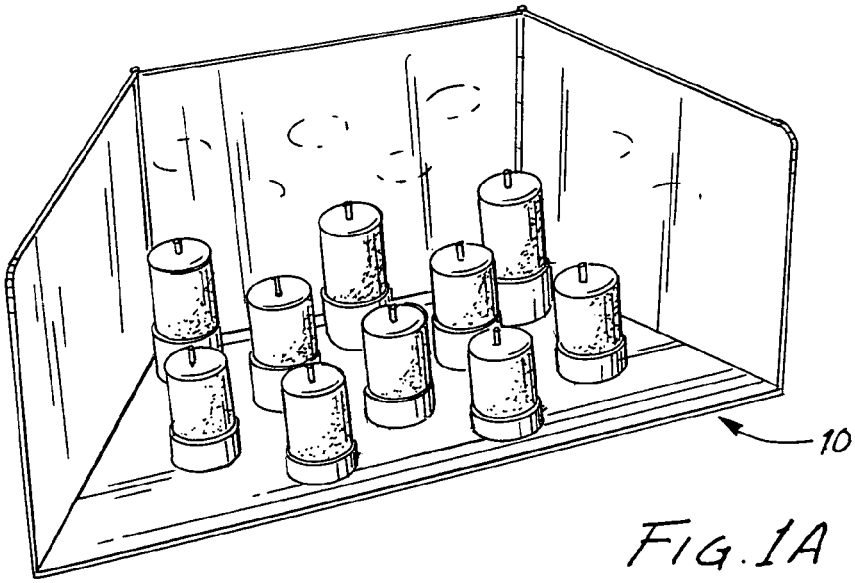
FIG. 1A illustrates a perspective view of three light reflecting sides and a reflecting bottom supporting a plurality of candles mounted upon candle holders.
Figure 1:
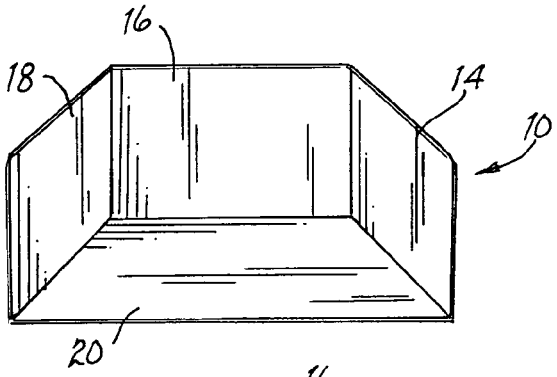
FIG. 1 is duplicative of FIG. 1A with the candles and candle holders removed.
Figure 2:
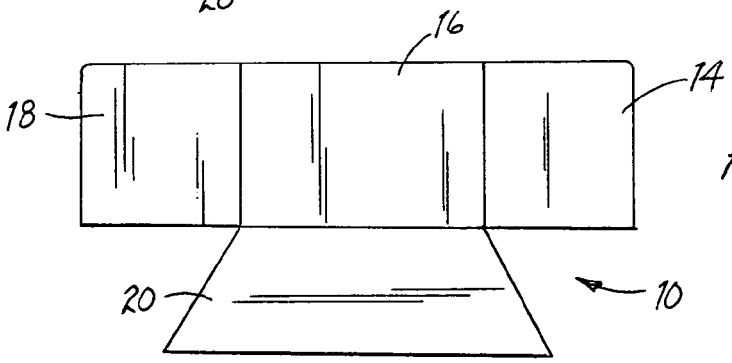
FIG. 2 illustrates in plan form the connected parts shown in FIG. 1.
Figure 3:
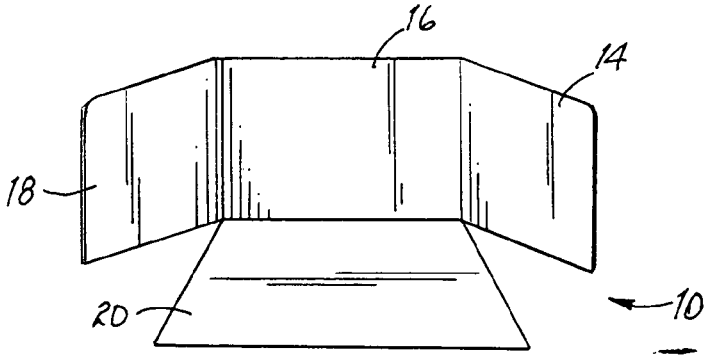
FIG. 3 illustrates partial folding of the parts of the reflector.
Figure 4:
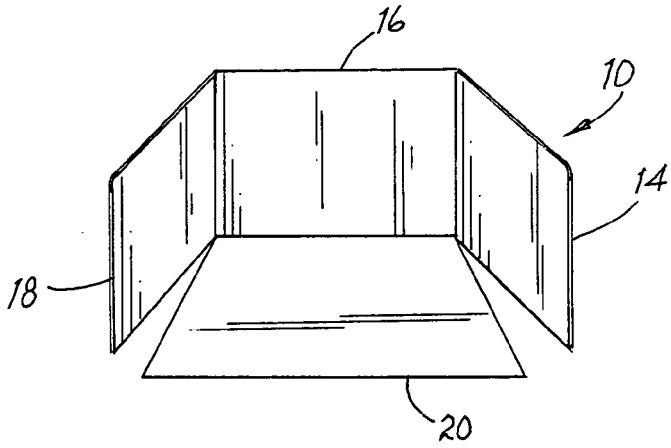
FIG. 4 illustrates further folding of the parts of the reflector shown in FIG. 1.
Figure 5:
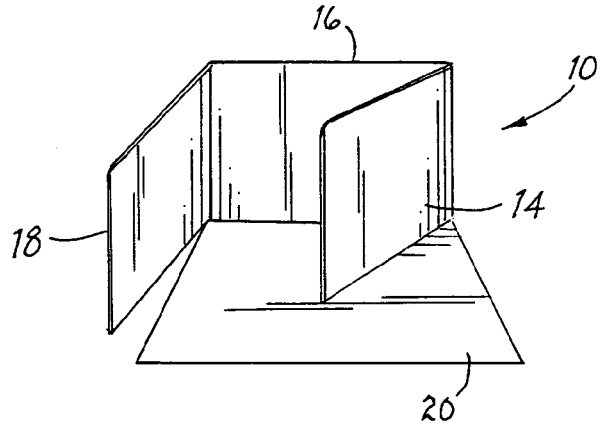
FIGS. 5, 6 and 7 illustrate the manner of folding the reflector for storage and transportation purposes.
Figure 6:
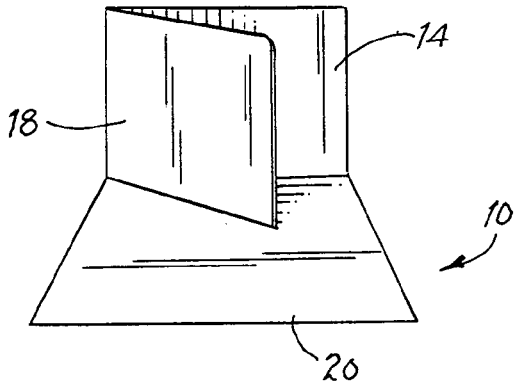
Figure 7:
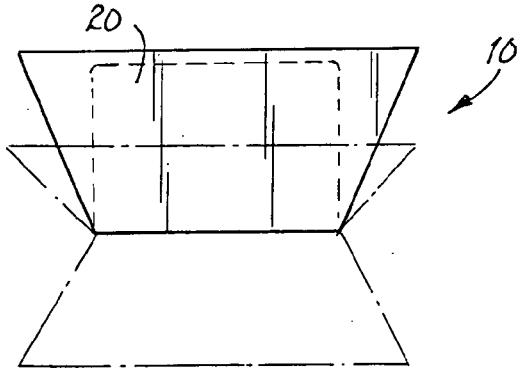

FIGS. 1–5 shows various aspects of an exemplary embodiment of the candle fireplace illuminator of the present invention generally designated 10. Candle fireplace illuminator 10 includes a multi-reflector element assembly 12 that is foldable for storage and which unfolds into a three-sided, single-bottomed reflector assembly having 3 side reflective surfaces 14, 16, 18 and a bottom reflective surface 20 for supporting a number of candles on a number of candle holders or candelabras such that the candles may be used within a fireplace to provide illumination into a room by light reflecting from the four reflective surfaces.

It can be seen from the preceding description that fireplace insert has been provided.

It is noted that the embodiment of the candle fireplace illuminator described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A candle fireplace illuminator comprising:

a multi-reflector element assembly that is foldable for storage and which unfolds into a three-sided, single-bottomed reflector assembly having four reflective elements and which has a bottom reflective element supporting a plurality of candles each mounted on a candleholder, the candles be usable within a fireplace to provide illumination into a room by light reflecting from the four reflective surfaces.

* * * * *